US005520248A

United States Patent [19]

Sisson et al.

[11] Patent Number: 5,520,248

[45] Date of Patent: May 28, 1996

[54] METHOD AND APPARATUS FOR DETERMINING THE HYDRAULIC CONDUCTIVITY OF EARTHEN MATERIAL

[75] Inventors: James B. Sisson; Thomas K. Honeycutt; Joel M. Hubbell, all of Idaho Falls, Id.

[73] Assignee: Lockhead Idaho Technologies Company, Idaho Falls, Id.

[21] Appl. No.: 368,180

[22] Filed: Jan. 4, 1995

[51] Int. Cl.[6] ..... G01N 15/08; E21B 47/00

[52] U.S. Cl. ..... 166/250.02; 73/38

[58] Field of Search ..... 166/250, 264, 166/279, 53, 66; 73/38, 61.67, 64.3; 60/443

[56] References Cited

U.S. PATENT DOCUMENTS

| | | | |
|---|---|---|---|
| 4,506,542 | 3/1985 | Rose | 73/38 |
| 4,571,985 | 2/1986 | Daly | 73/38 |
| 4,679,422 | 7/1987 | Rubin et al. | 73/38 |
| 4,823,552 | 4/1989 | Ezell et al. | 60/443 |
| 4,969,111 | 11/1990 | Merva | 73/73 X |
| 5,156,205 | 10/1992 | Prasad | 166/250 |
| 5,269,180 | 11/1993 | Dave et al. | 166/250 X |
| 5,337,821 | 8/1994 | Peterson | 166/250 |

OTHER PUBLICATIONS

"Determination of Diffusivity and Hydraulic conductivity in Soils at Low Water Contents From Nondestructive Transient Flow Observations", Mark Grismer, D. B. McWhorter & A. Klute (pp. 10–11) 1986.

"Evaluation of the Flow Pump and Constant Head Techniques for Permeability Measurements", S. A. Aiban & D. Znidarcic (pp. 655–658) 1989.

"Flux–Controlled Sorptivity Measurements to Determine Soil Hydraulic Property Functions", S. Dirksen (pp. 827–829 (1979).

*Primary Examiner*—Frank S. Tsay

*Attorney, Agent, or Firm*—Wells St. John Roberts Gregory & Matkin

[57] ABSTRACT

An earthen material hydraulic conductivity determining apparatus includes, a) a semipermeable membrane having a fore earthen material bearing surface and an opposing rear liquid receiving surface; b) a pump in fluid communication with the semipermeable membrane rear surface, the pump being capable of delivering liquid to the membrane rear surface at a plurality of selected variable flow rates or at a plurality of selected variable pressures; c) a liquid reservoir in fluid communication with the pump, the liquid reservoir retaining a liquid for pumping to the membrane rear surface; and d) a pressure sensor in fluid communication with the membrane rear surface to measure pressure of liquid delivered to the membrane by the pump. Preferably, the pump comprises a pair of longitudinally opposed and aligned syringes which are operable to simultaneously fill one syringe while emptying the other. Methods of determining the hydraulic conductivity of earthen material are also disclosed.

29 Claims, 10 Drawing Sheets

METHOD AND APPARATUS FOR DETERMINING THE HYDRAULIC CONDUCTIVITY OF EARTHEN MATERIAL

CONTRACTUAL ORIGIN OF THE INVENTION

The United States Government has rights in this invention disclosed under contract number DE-AC07-76ID01570 between the U.S. Department of Energy and EG&G Idaho, Inc., now contract number DE-AC07-94ID13223 with Lockheed Idaho Technologies Company.

TECHNICAL FIELD

This invention relates to methods of and apparatus for determining the hydraulic conductivity of earthen material.

BACKGROUND OF THE INVENTION

The hydraulic conductivity of geologic materials is an important variable for estimating the rate of transport of contaminants from waste sites. Hydraulic conductivity within earthen material varies with soil water pressure and soil water content.

Prior art instruments for estimating hydraulic conductivity under field conditions fall under two general classes. The first class includes borehole permeameters where water is initially ponded at the bottom of a borehole provided in the earth. Mechanisms are provided for monitoring the liquid level of water within the borehole, and water is added to maintain the liquid in the borehole at a constant level. The rate of water flow required to maintain a constant level of water is utilized to estimate soil hydraulic conductivity at the base of the bore at or near field liquid saturation. This class of instruments also includes modifications whereby the rate of a falling head of liquid within a borehole is monitored, or where an instrument is used at the soil surface and soil infiltration is confined to a ring.

A second class of instruments applies water to the soil surface under negative pressure (i.e., under tension) through a membrane that is permeable to water but not air.

Both classes of instruments operate at or near conditions where the soil is saturated with water and use changes in the volume of water maintained in a reservoir to estimate the soil water fluxes into the soil. Air pressure in the reservoirs is used to regulate the depth of water in a borehole, ring or membrane, and accordingly changes in temperature and atmospheric conditions cause changes that produce errors in the estimated fluxes and pressures. These prior art instruments also require considerable patience and expertise to maintain in the field, and to interpret the resulting data.

Ideal operation of a hydraulic conductivity determining apparatus requires fluxes and pressures to be accurately known. Since soil water pressures and soil water content conditions in the field are often far removed from saturated conditions, an ideal instrument would operate under soil water pressures less then negative 30 kPa and soil water fluxes less then 1 mm/day. The determination of fluxes less than 1 cm/day requires an ideal instrument to operate unattended for several days in the field to reach a steady flux and soil water pressure.

It would be desirable to overcome these and other drawbacks associated with the prior art in the development of an apparatus and improved methods for determining hydraulic conductivity in earthen material.

BRIEF DESCRIPTION OF THE DRAWINGS

Preferred embodiments of the invention are described below with reference to the following accompanying drawings.

FIG. 14 is a block diagram of a general procedure for performing forward step hysteresis determination.

DETAILED DESCRIPTION OF THE PREFERRED EMBODIMENTS

Figure 1:
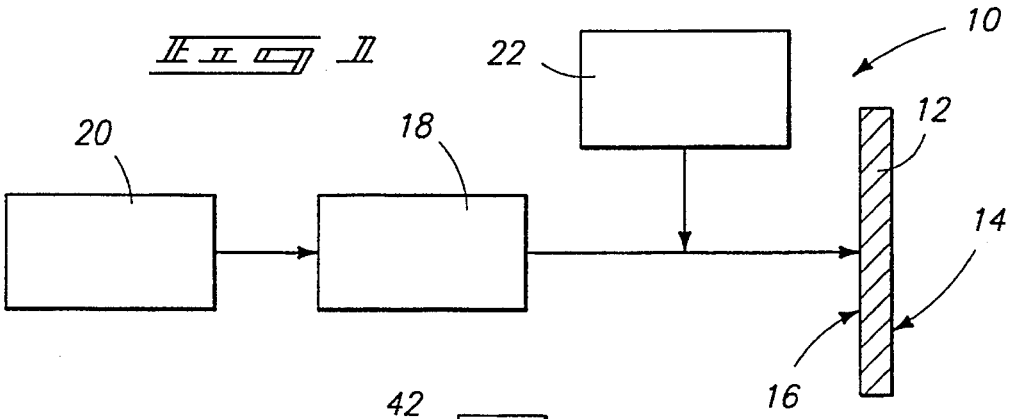
FIG. 1 is a diagrammatic or schematic representation of a hydraulic conductivity determining apparatus for determining hydraulic conductivity in earthen material in accordance with the invention.

This disclosure of the invention is submitted in furtherance of the constitutional purposes of the U.S. Patent Laws "to promote the progress of science and useful arts" (Article 1, Section 8).

In accordance with one aspect of the invention, a method of determining the hydraulic conductivity of earthen material comprises the following steps:

applying a semipermeable membrane against earthen material, the semipermeable membrane having a fore earthen material bearing surface and an opposing rear liquid receiving surface;

providing a flow of liquid to the rear semipermeable membrane surface at a first flow rate;

determining pressure of the liquid delivered to the rear surface at the first flow rate;

continuing liquid flow at the first rate until an equilibrium first liquid pressure is determined;

providing a flow of liquid to the rear semipermeable membrane surface at a second flow rate, the second flow rate being different from the first flow rate;

determining pressure of the liquid delivered to the rear surface at the second flow rate;

continuing liquid flow at the second rate until an equilibrium second liquid pressure is determined; and using the determined first and second equilibrium pressures to determine the hydraulic conductivity of the earthen material.

In accordance with another aspect of the invention, a method of determining the hydraulic conductivity of earthen material comprises the following steps:

applying a semipermeable membrane against earthen material, the semipermeable membrane having a fore earthen material bearing surface and an opposing rear liquid receiving surface;

providing a flow of liquid to the rear semipermeable membrane surface at a first constant pressure;

varying the flow of liquid to the rear membrane surface to maintain the first constant pressure;

continuing to vary the flow of liquid to maintain the first constant pressure until an equilibrium first flow rate is achieved;

providing a flow of liquid to the rear semipermeable membrane surface at a second constant pressure, the second constant pressure being different from the first constant pressure;

varying the flow of liquid to the rear membrane surface to maintain the second constant pressure;

continuing to vary the flow of liquid to maintain the second constant pressure until an equilibrium second flow rate is achieved; and using the first and second equilibrium flow rates to determine the hydraulic conductivity of the earthen material.

In accordance with yet another aspect of the invention, an earthen material hydraulic conductivity determining apparatus for determining hydraulic conductivity of in a bore hole of earthen material comprises:

a longitudinally elongated body;

a pair of syringes received within the elongated body, each syringe having a respective piston, each syringe having a respective syringe inlet/outlet port, the syringes being longitudinally opposed within the body with their respective inlet/outlet ports facing away from one another, the piston of each syringe being connected to the other by a common driver, the driver being movable between opposing longitudinal limits;

a liquid reservoir in fluid communication with the inlet/outlet port of each syringe;

a liquid delivery conduit in fluid communication with the inlet/outlet port of each syringe, the liquid delivery conduit having a liquid emitting terminus positionable to emit liquid onto earthen material within the bore;

a valve in fluid communication with each syringe inlet/outlet port, the valves being operable to place the respective inlet/outlet ports in fluid communication with either of the liquid reservoir or the liquid delivery conduit;

a syringe controller, the syringe controller being operable to fill one syringe of the pair with liquid from the reservoir while ejecting fluid from the other syringe of the pair to the liquid delivery conduit, the syringe controller being operable to reverse movement of the driver upon driver movement to either of the opposing longitudinal limits; and a pressure sensor in fluid communication with the liquid delivery conduit to measure pressure of liquid within the delivery conduit.

More particularly and first with reference to FIG. 1, a hydraulic conductivity determining apparatus for determining hydraulic conductivity of earthen material is diagrammatically and generally indicated with reference numeral 10. Such comprises a semipermeable membrane 12 having a fore earthen material bearing surface 14 and an opposing rear liquid receiving surface 16. A pump 18 is provided in fluid communication with semipermeable membrane rear surface 16. The pump is capable of delivering liquid to membrane rear surface 16 at a plurality of selected flow conditions, such as variable flow rates and/or a plurality of selected variable pressures. A liquid reservoir 20 is provided in fluid communication with pump 18. Reservoir 20 retains liquid, typically water, which has been degassed for pumping to membrane rear surface 16. A pressure sensor 22, preferably in the form of an electronic pressure transducer, is provided in fluid communication with membrane rear surface 16 to measure pressure of liquid delivered to membrane 12 by pump 18. Conceptionally, the apparatus has utility for determining hydraulic conductivity of earthen material at the earth's surface, in a laboratory setting and within a borehole provided in the earth at one or more elevational locations within the borehole.

Figure 2:
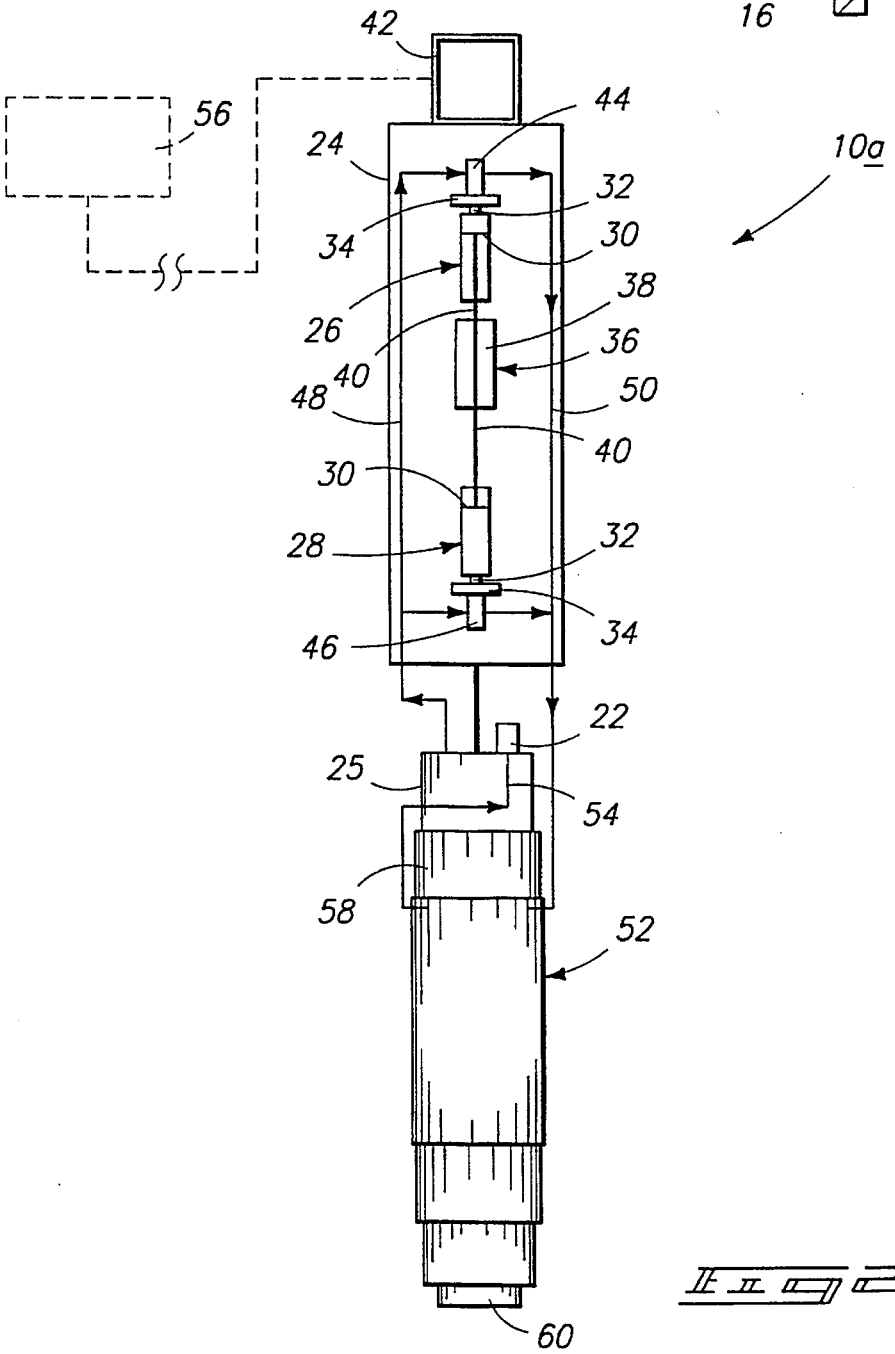
FIG. 2 is a diagrammatical view in more detail of a hydraulic conductivity determining apparatus in accordance with the invention.

A preferred embodiment construction is diagrammatically shown and described in somewhat more detail with reference to FIG. 2. Like numbers from FIG. 1 are utilized where appropriate. FIG. 2 diagrammatically illustrates a hydraulic conductivity determining apparatus, or permeameter **10*a* principally adapted for determining hydraulic conductivity in a borehole. Apparatus 10*a* is longitudinally elongated, and is shown as being comprised of a pair of longitudinally elongated bodies 24 and 25. The pump 18 of FIG. 1 is comprised of a pair of syringes 26 and 28 which are received in upper elongated body 24. Each syringe has a respective plunger 30 and a respective syringe inlet/outlet port 32. Syringe outlets 32 are mounted to respective mounting plates 34 to retain syringes in body 24 in longitudinally opposed positions, with the respective inlet/outlet ports 32 facing away from one another. Also preferably and as shown, the pair of syringes 26 and 28 are positioned with their respective longitudinal axes positioned in perfect longitudinal alignment with one another within body 24**. Example syringes are 10 mL syringes available from Ideal Instruments of Chicago, Ill.

The piston of each syringe is connected to the other by a common driver mechanism 36. Such preferably consists of a stepper motor and controller 38, and a common drive shaft 40 extending therethrough which effectively connects with each syringe plunger 30. Stepper motor and controller 38 would be controlled by a programmable logic controller (PLC) 42 schematically shown mounted a top body 24. Shaft 40 is preferably a single threaded drive shaft which extends through stepper motor 38, and is accordingly moveable between opposing longitudinal limits. In FIG. 2, plunger 30 of top syringe 26 is shown at a topmost near-limit injection travel, while plunger 30 of bottom syringe 28 is shown in a bottom-most near-limit of it's syringe-filling travel. A stepper motor controller and linear actuator stepper motor with drive shaft 40 are available from American Precision Industries Controls Division of Buffalo, N.Y., as catalog numbers CMD-40C and 6100T1846. Example programmable logic controllers include models #440e available from Blue Earth Research of Mankato, Minn. or, #95616 Model Tiny Drive Microcontroller available from TERN Inc. of Davis, Calif.

Electronic valves 44 and 46 are connected to the respective mounting plates 34 and in fluid communication with each respective syringe inlet/outlet port 32. Example valves are #075T3MP12-32, available from Bio-Chem Valve Corp, of Boonton, N.J. Valves 44 and 46 are in fluid communication via a line 48 to a liquid reservoir 20 (FIG. 1, not shown in FIG. 2) which can be retained in lower elongated body 25. Thus, the liquid reservoir is in fluid communication with each inlet/outlet port 32 of each syringe. The liquid reservoir preferably comprises an air-sealable, collapsible, flexible bladder. Thus, upon withdrawal of the fluid from such a reservoir, air is substantially prevented from contacting and dissolving in the liquid.

Valves 44 and 46 also connect with a liquid delivery conduit 50 which extends from upper elongated body 24 to lower elongated body 25, ending at a liquid emitting terminus 52 which is positionable to emit liquid onto earthen material within the borehole. The terminus is preferably in the form of a semipermeable membrane described in more detail below. A pressure sensor 22 is in fluid communication with semipermeable membrane construction 52 via a conduit 54. Thus, sensor 22 is also in fluid communication with liquid delivery conduit. An example and preferred pressure sensor is a Model ST2P15G4A available from Sen Sym, of Sunnyvale, Calif.

Valves 44 and 46 are operable to place the respective inlet/outlet ports 32 of each syringe 26 and 28 in fluid communication with either of the liquid reservoir or the liquid delivery conduit 50. Operable positioning of valves 44 and 46 is controlled by programmable logic controller 42. Programmable logic controller 42 thus constitutes a syringe controller which is operable to fill one syringe of the pair with liquid from the reservoir while ejecting fluid from the other syringe of the pair to the liquid delivery conduit. The syringe controller is operable to reverse movement of the driver upon driver movement to either of the opposing longitudinal limits.

For example, while stepper motor 38 was being controlled to drive linear actuator 40 upwardly, valve 44 would be positioned by logic controller 42 to cause fluid emitted from syringe 26 to flow into liquid delivery conduit 50 to semipermeable membrane 52. Valve 46 would be positioned to close its access to delivery conduit 50 and open its access with respect to fluid reservoir conduit 48. Thus, bottom syringe 28 simultaneously fills with liquid from the liquid reservoir while liquid is ejected from top syringe 26. Upon linear actuator 40 reaching a mechanical or logic controller determined uppermost limit, controller 42 would reverse the stepper motor and the valve positioning such that bottom syringe 28 would emit fluid into liquid delivery conduit 50 while top syringe 26 would be simultaneously filled with liquid from the reservoir via conduit 48. Programmable logic controller 42 would preferably be controlled and programmed as directed by a user via an above ground based personal computer 56.

Figure 6:
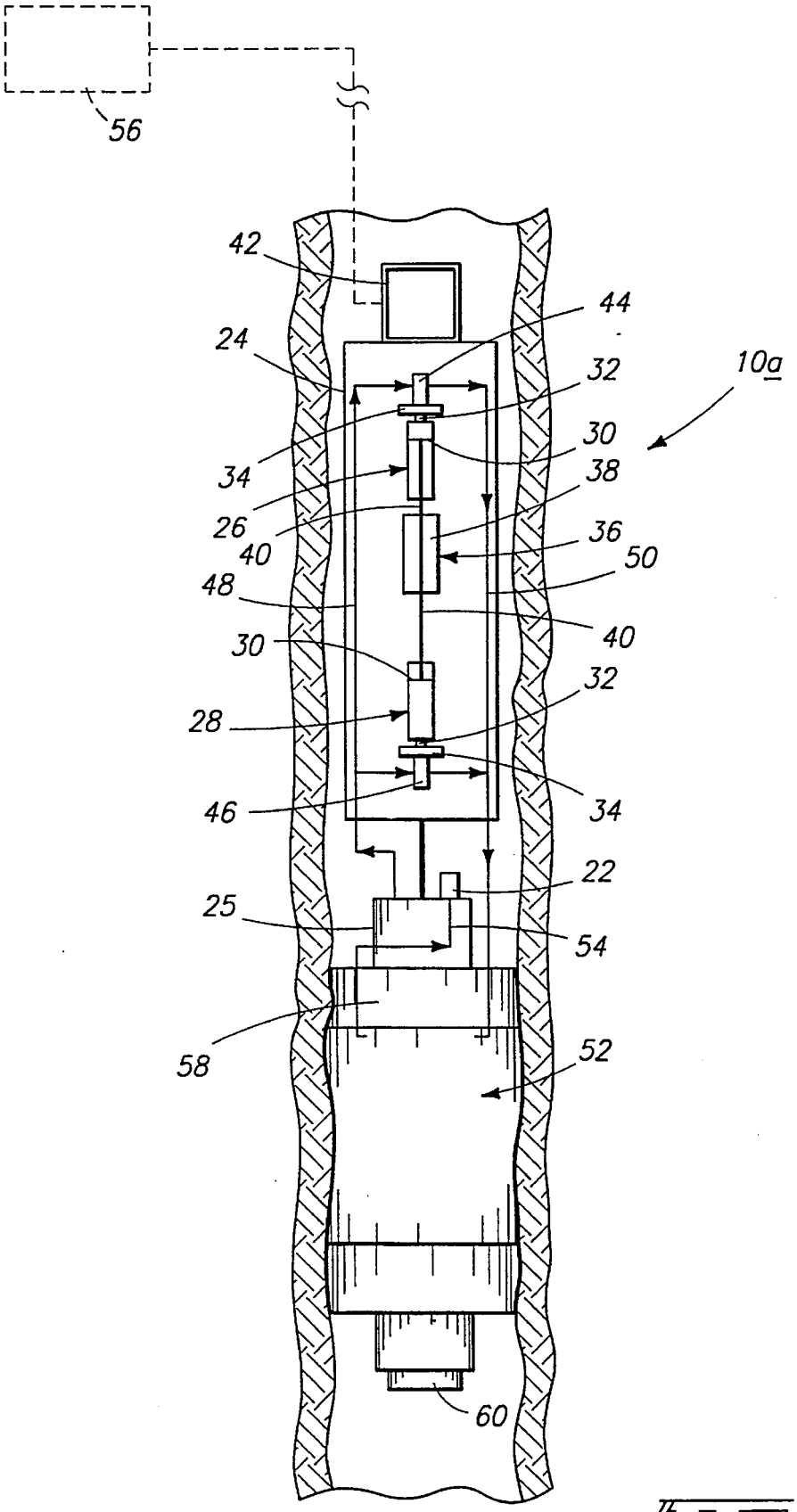
FIG. 6 is a diagrammatic view of the FIG. 2 apparatus shown within a borehole in operation engaging side walls of the bore for determining hydraulic conductivity of earthen material.

Referring further to the FIG. 2, semipermeable membrane 52 is constructed to be cylindrical and received about an inflatable bladder 58. Inflatable bladder 58, in turn, is preferably receives air from a pump 60 (controlled by controller 42) enabling semipermeable membrane 52 to be outwardly expandable for engaging side walls of a bore. FIG. 2 diagrammatically illustrates apparatus 10*a* with semipermeable membrane 52 and bladder 58 in a non-inflated condition. FIG. 6 illustrates inflatable bladder 58 filled with air such that semipermeable membrane outwardly expands and bears against the side walls of the illustrated earthen bore hole.

Figure 3:
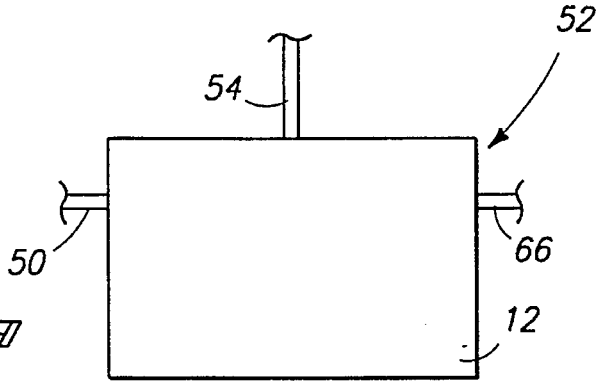
FIG. 3 is a diagrammatic view of a semipermeable membrane utilized in the FIG. 2 apparatus.

Semipermeable membrane 52 is preferably in the form of an elongated planar sheet which is cylindrically wrapped and overlaps with itself to form the illustrated cylinder about bladder 58. An example and preferred construction is diagrammatically shown and described with reference to FIGS. 3 and 4. Example suitable materials for semipermeable membrane 52 include Nos. N04SP00010 (0.45 micron pore size), N12SP00010 (1.2 micron pore size) and N08SP00010 (0.8 micron pore size) available from Micron Separations Inc., of West Borough, Mass. Outer edges of semipermeable membrane material 12 are bonded onto an impermeable backing material 62, with a plastic rear membrane surface backing screen 64 being provided therebetween. Liquid delivery conduit 50 extends through impermeable backing sheet 62 and emits or is in fluid communication with screen 64. The inflatable bladder 58 of FIG. 2 would bear against the lower FIG. 4 surface of sheet 62 thus forcing fore membrane surface 14 against the bore side walls.

Example materials of construction for sheet 62 and screen 64 include vinyl, polyethylene or styrene. Plastic screen 64 is advantageously provided to insure uniform water pressure over rear semipermeable membrane surface 16. A supplemental tube 66 also extends through impervious sheet 62 to screen 64 for removing entrapped air during initial filling of the screen area and semipermeable membrane. Pressure transducer conduit 54 also extends through impervious layer 62 to provide fluid communication of the pressure transducer to liquid delivered by liquid delivery conduit 50 to membrane 52.

Figure 4:
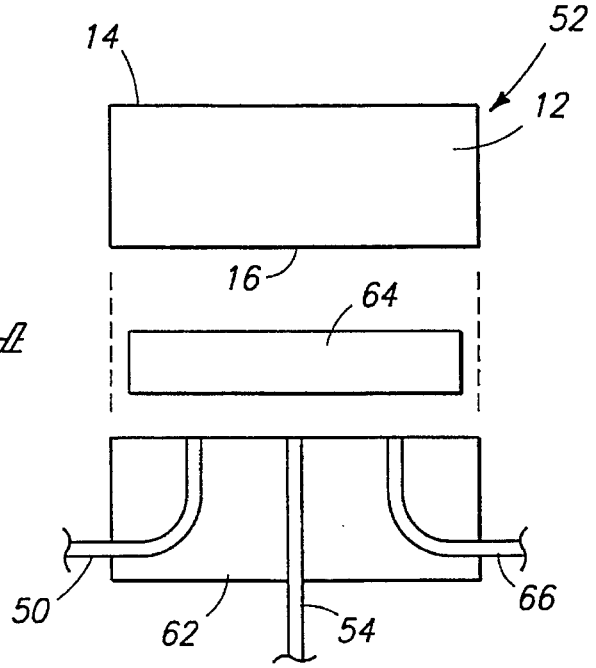
FIG. 4 is an exploded side elevational view of the FIG. 3 membrane.

The illustrated pad is constructed by laying down the impermeable material 62 and providing it at a size slightly larger than membrane material 12. Tubes which define conduits 50, 54 and 66 are tacked thereto and overlaying screen 64 is thereafter provided. The various illustrated constructions illustrated in exploded view in FIG. 4 are held together by a suitable water resistant adhesive which is provided around the perimeter to form a permanent seal. The pad can then be tested by applying a vacuum to the tubes and watching for air bubble movement in the screened area. The finished construction would then be wrapped around the inflatable bladder 58 in an overlapping manner to accommodate outward expansion of the bladder, with one end of the semipermeable membrane construction being secured by adhesive, clamps or string to the bladder.

Figure 5:
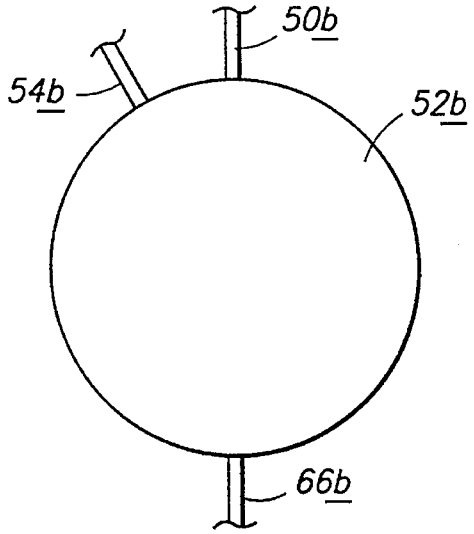
FIG. 5 is a diagrammatic view of an alternate semipermeable membrane utilizable with apparatus and methods in accordance with the invention.

FIG. 5 diagrammatically illustrates an alternate embodiment and shaped semipermeable membrane 52*b*. Such is illustrated in the form of a simple disk. Such a construction might be utilizable for measuring soil hydraulic conductivity against a flat earthen material surface, such as by way of example, above grade or at the base of a borehole or other opening provided in the earth's surface. In contrast, the above described FIG. 2 embodiment applies a flexible semipermeable membrane against an arcuate earthen material surface within a cylindrical borehole. Other constructions and methods are of course contemplated with the invention only being restricted by the accompanying claims appropriately interpreted in accordance with the Doctrine of Equivalents.

The above described apparatus is capable of operating at depths exceeding 100 feet, and provide flow rates from 10 liters a day or greater to less then 1 milliliter per day, while monitoring pressure. The above syringe valve and reservoir construction provides the advantage of enabling larger volumes of liquid to be contained and pumped than would be contained in a single syringe. The construction also enables flow direction to be switched if desired to pull water from the soil as well as inject water into it via semipermeable membrane 52. The above construction also enables pumping of a wider range of flow rates than is currently available from prior art permeameters. Programmable logic controller 42 and personal computer 56 also enable the programming of the pump and metering of water through a sequence of rates or pressures without an operator being required to be present.

Further, the pump in the form of the syringes can be programmed to apply (or extract) water as a function of time, such as the square root of time, and not just as a constant rate. The logic controller can also be programmed to pump liquid at variable flow rates such that a constant pressure can be maintained at the semi-permeable membrane while simultaneously recording flow rates. This is useful in some procedures for estimating hydraulic properties. Accordingly, the apparatus is operable in accordance with the above described methods to provide liquid to semipermeable membrane 52 at a constant flow rate while monitoring pressures, at a constant pressure while monitoring flow rates, at a rate that is a function of time while monitoring pressures, or at a pressure that is a function of time while monitoring flow rates. The above construction also provides for miniaturization, enabling a construction which can fit into a borehole and be operated at any depth below land surface, including being operated at land surface.

EXAMPLE TEST PROCEDURES

Several laboratory and field tests have been conducted using the above pump and pad system developed as components for the borehole permeameter. The pump was connected to a burette and a series of delivery volumes programmed into the PLC. Results of these tests indicated that the system exceeded the design specifications for delivery volumes and rates of flow of ±1% for a given rate and delivery volume. In addition, the pump was found reliable over time in that it could deliver water at a constant flow rate over a period of one month, provided no power outages occurred.

Figure 7:
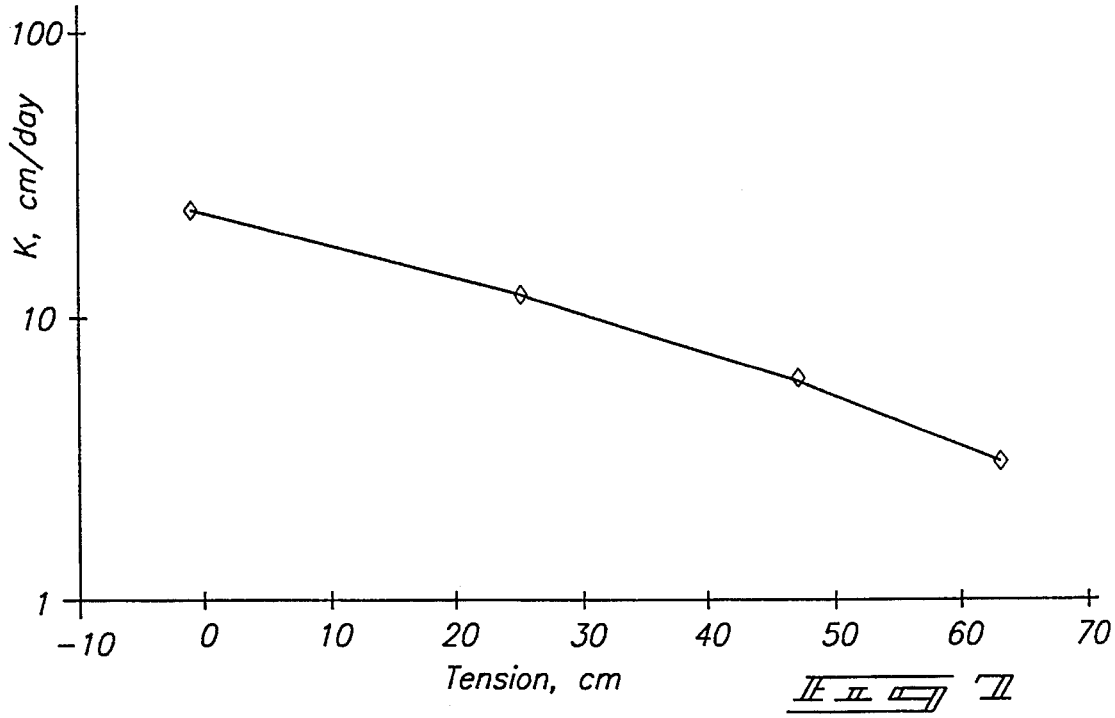
FIG. 7 is a plot of hydraulic conductivity soil water tension for a sandy loam soil.

A laboratory column was instrumented with the pump and pad system to infiltrate water vertically into a Pancheri sandy loam. Water was metered at flow rates ranging from 3 to 30 cm per day, while soil water tension was monitored at the soil surface through the pad using the electronic pressure transducer referred to above. In the one-dimensional flow geometry, the hydraulic conductivity is numerically equal to the metered flow rate once a steady soil water tension is reached. The hydraulic conductivities obtained are shown in graphical form on FIG. 7.

Hydraulic conductivity at a given soil water tension can be different depending on whether the soil is wetting or drying, a phenomena known as hysteresis. A laboratory column was filled with sand and instrumented with time domain reflectometer (TDR) probes and the pump and pad apparatus. The TDR probes provided water content measurements. The results of this study are shown in FIGS. 8, 9 and 10.

Figure 8:
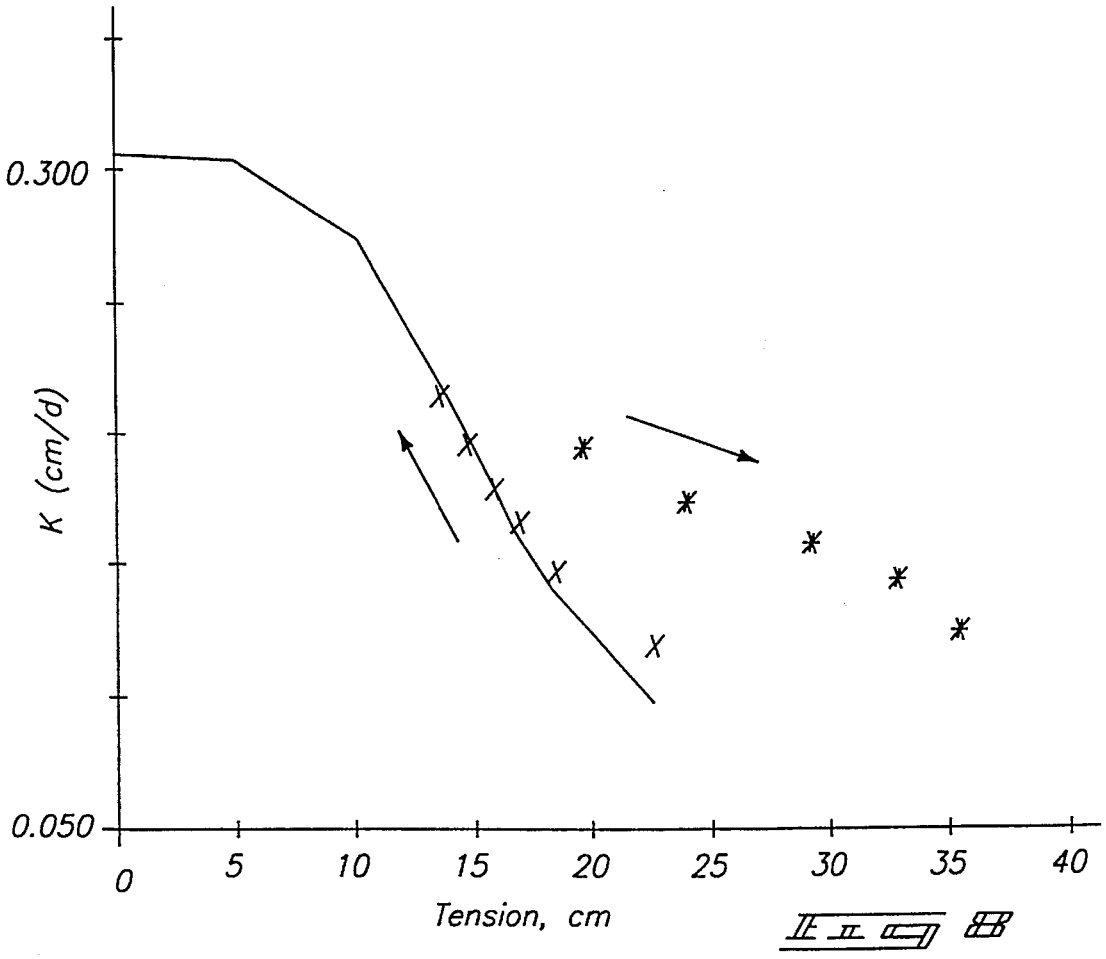
FIGS. 8, 9 and 10 are plots of hydraulic properties of sand taken from a hysteresis study.

FIG. 8 shows hydraulic conductivity plotted against soil water tension for the sand. The arrows indicate the direction of water content changes. This is the first data, known to the inventors, where hydraulic conductivity, tension, and soil water content were obtained simultaneously. In addition, no known data exists where scanning loops in hydraulic conductivity soil water tension curves were observed. These data are typically obtained for only the primary wetting and drying curves.

Figure 9:
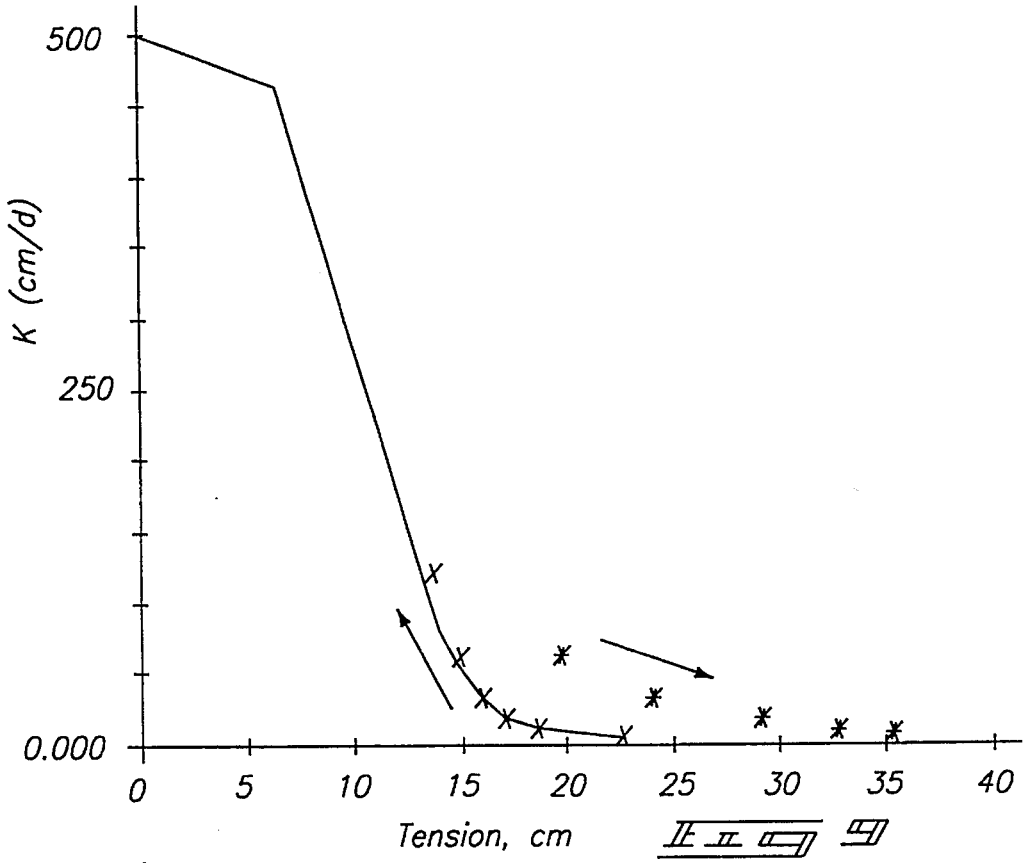

FIG. 9 shows the soil water tension as a function of water content over the range of tensions obtained during the wetting and drying portion of the experiment.

Figure 10:
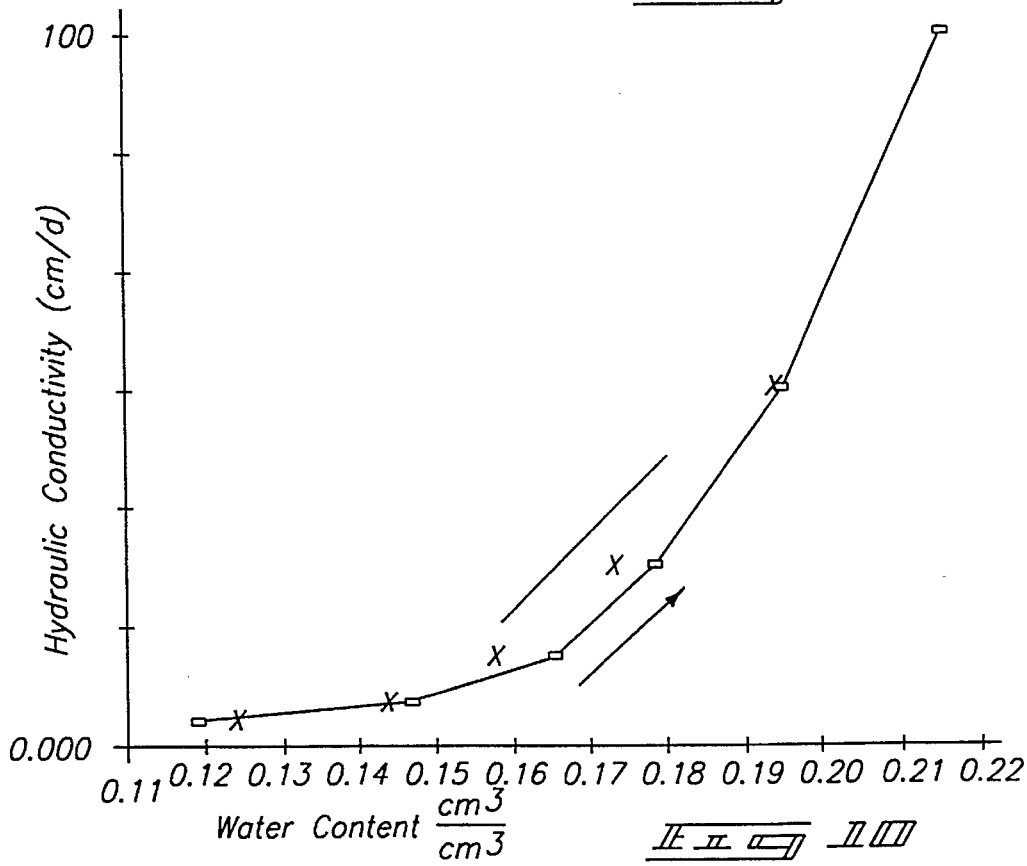

FIG. 10 is hydraulic conductivity plotted against water content. As reported in the literature, the differences between wetting and drying appear to be small. While the data do not show a complete wetting and drying cycle, the results are encouraging in that the entire experiment took less then 12 hours to complete after instrumenting the column.

The above described preferred embodiment borehole permeameter was operated in the field in two configurations. The first configuration is that of a disk permeameter and the second is as a borehole permeameter. The pump and disk-shaped pads operated well under field conditions and could be left in an unattended mode for long periods of time, thus greatly reducing the tedium involved with field determinations.

Figure 11:
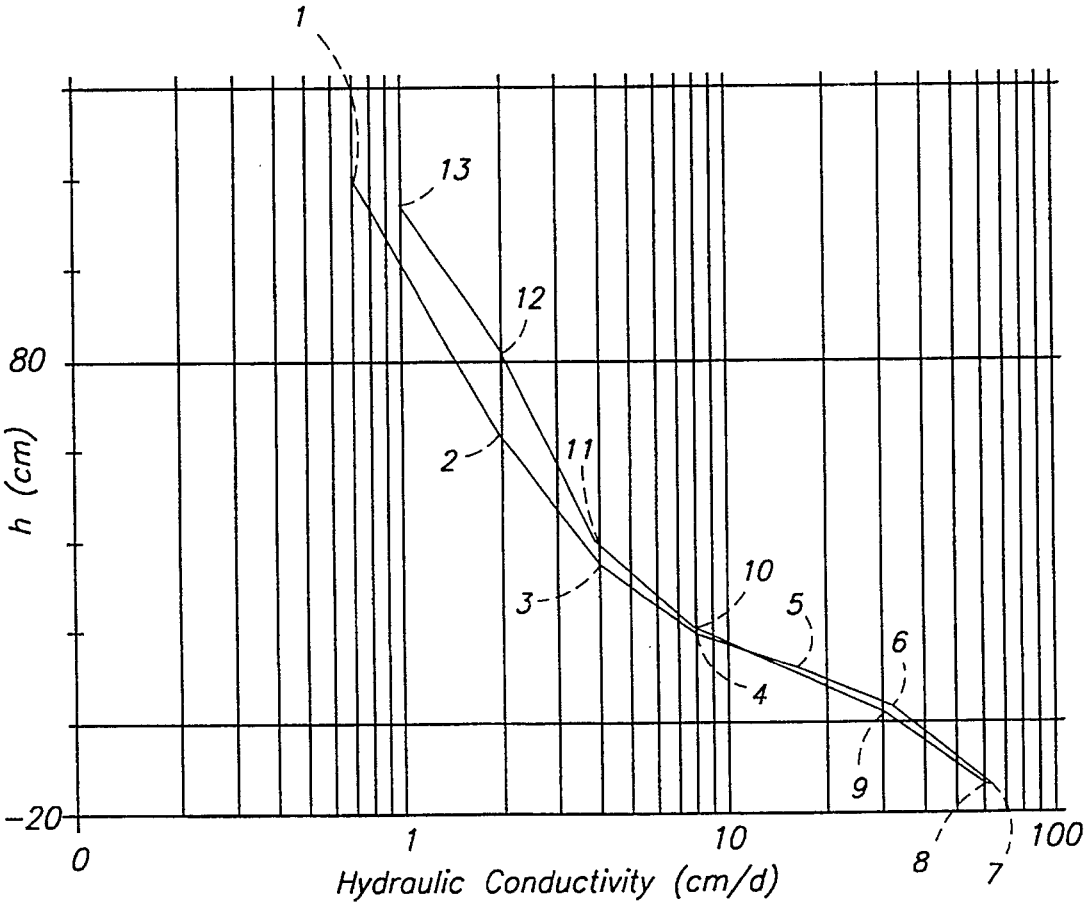
FIG. 11 is a plot of tension borehole permeameter results of analysis of sandy loam soil, with the numbers indicating the order in which the data were obtained.

Tests of the borehole permeameter were conducted in shallow boreholes less than 1 meter in depth. The soil used in this study was the Pancheri sandy loam, a soil exulted in potato production circles. The results of tests conducted at the 30 cm depth are shown in FIG. 11. The preliminary results shown in FIG. 11 were estimated from the following borehole permeameter equation, $$Q = AK_{fs} + B\phi_m$$

where $$A = \frac{2\pi H^2}{C} + \pi\alpha^2$$

$$B = \frac{2\pi H}{C}$$

where C is the dimensionless "shape factor" given by $$C = \frac{2\pi H}{\ln\left[\frac{H}{D} + \left(1 + \left(\frac{H}{D}\right)^2\right)^{1/2}\right]} - 2.75D$$

and Q ($L^3T^{-1}$) is the rate of pumping $K_{fs}$ ($LT^{-1}$) is the hydraulic conductivity at field saturation, $\alpha$ ($L^{-1}$) is the characteristic pore length in the soil, D (L) is the bore hole diameter, H(L) is the vertical height of the porous injection pad. Equation (1) was derived assuming that the hydraulic conductivity tension function is closely approximated by $$K(h) = K_s e^{(\alpha h)}$$

and $$\phi_m(h) = \int_0^h K_s e^{(\alpha h)} = \frac{K_s}{\alpha} e^{(\alpha h)}$$

where $K_s$ is the saturated hydraulic conductivity (i.e., K(O)). The first term in Equation (1) compensates for a saturated bulb that forms around the injection point in conventional borehole permeameter operation. Since the apparatus measures water under tension, a saturated bulb never develops and the first term in Equation (1) can be set to 0. Thus, $$Q = \frac{2\pi H}{C}\phi_m(h) = \frac{2\pi HK_s}{C\alpha} e^{(\alpha h)}$$

Equation (7) has two unknowns $K_s$ and $\alpha$, that were estimated after taking logs of both sides. The resulting linear curves are shown as solid lines in FIG. 11. The lack of hysteretic affects is anomalous. Probable reasons include the fact that the apparatus was installed in a calcareous soil horizon and the fact that the test was conducted at the 30 cm depth. The calcareous nature of the soil may have been sufficient to cement the soil grains together and fill in pores that normally would participate in hysteretic effects. The effect of conducting the test at depth would be to confine the soil and prevent shrinking and swelling. This explanation requires movement of soil grains to be a factor in hysteresis phenomena. But due to the lack of hysteresis data for a wide range of soil types and textures in the literature, the proposed explanations must be considered speculative. The lack of hysteresis can be considered positive since only a wetting or drying cycle would be required and would reduce the time required for site characterization.

The apparatus has been tested in laboratory and field environments and is reliable, easy to operate, and can be left unattended for long periods of time. Laboratory tests indicate the apparatus can provide flow rates and volumes with a relative precision to within ±1%. In addition to being an instrument that can rapidly estimate hydraulic properties in boreholes, the apparatus is a tool which capable of simplifying laboratory studies too tedious to normally carry out, such as estimating hydraulic properties throughout hysteresis loops.

Comparing the above permeameter experiments to conventional methods shows the level of simplification in laboratory procedures that can take place. Conventional methods for estimating hydraulic conductivity require weeks to carry out using pressure plate and or hanging water columns. The procedures are so tedious that a graduate student is usually dedicated to the task of collecting and interpreting the data. In contrast, the pump can be programmed to sequence, non-stop, through the hydraulic conductivity values given in FIG. 7 and in an example required three days to complete. This finding indicates that it is now economically feasible with the invention to routinely estimate soil water hydraulic conductivities over a wide range of values in the laboratory and will provide valuable data to many risk assessment programs.

TEST PROCEDURES

Test procedures are intended to provide data regarding the performance of the borehole permeameter under field conditions. The following field tests were performed: (a) estimation of in situ unsaturated conductivity using steady state flow data; (b) estimation of in situ unsaturated conductivity using pumping follow-on drying curve data; (c) forward step hysteresis determination; (d) reverse step hysteresis determination; and (e) ease of equipment mobilization and maintenance.

Figure 12:
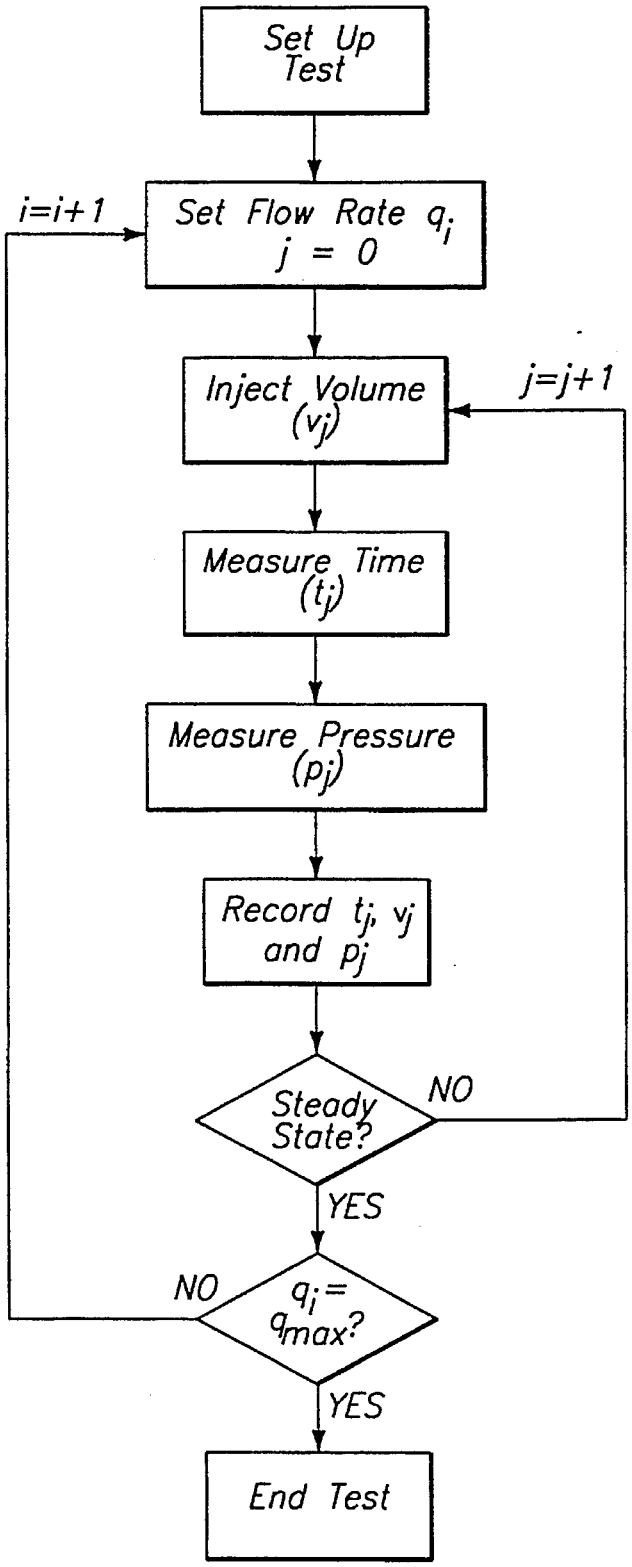
FIG. 12 is a block diagram of a general procedure for performing estimation of in situ unsaturated conductivity using steady state flow data.

One general test procedure for estimation of in situ unsaturated conductivity using steady state flow data is depicted in FIG. 12. Operation of the permeameter for this test is accomplished by lowering to depth, inflating the light packer to impress the membrane against the borehole wall, and metering water at the desired rate until a steady soil water tension is obtained. The process of metering water and obtaining steady state tension is repeated at successive rates of pumping until the desired range of tensions and flow rates are spanned.

Figure 13:
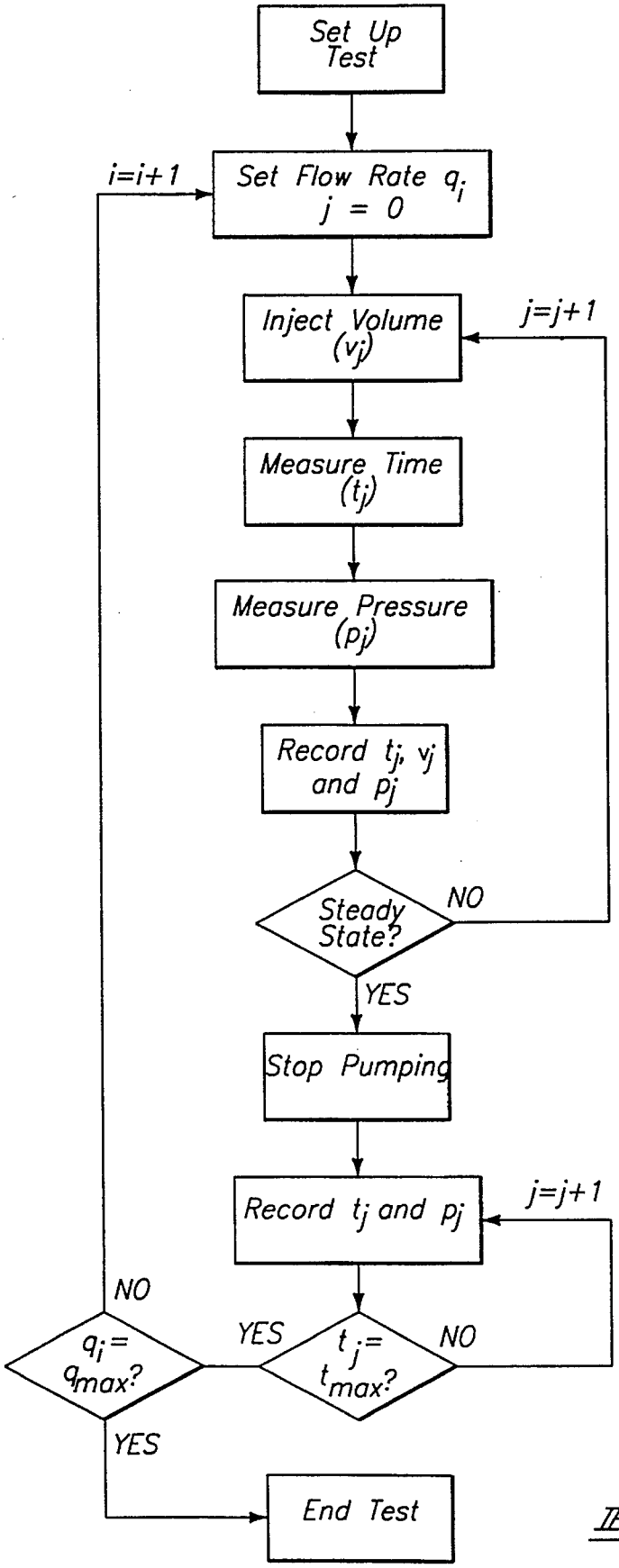
FIG. 13 is a block diagram of a general procedure for performing estimation of in situ unsaturated conductivity using drying curve data.
Figure 11:
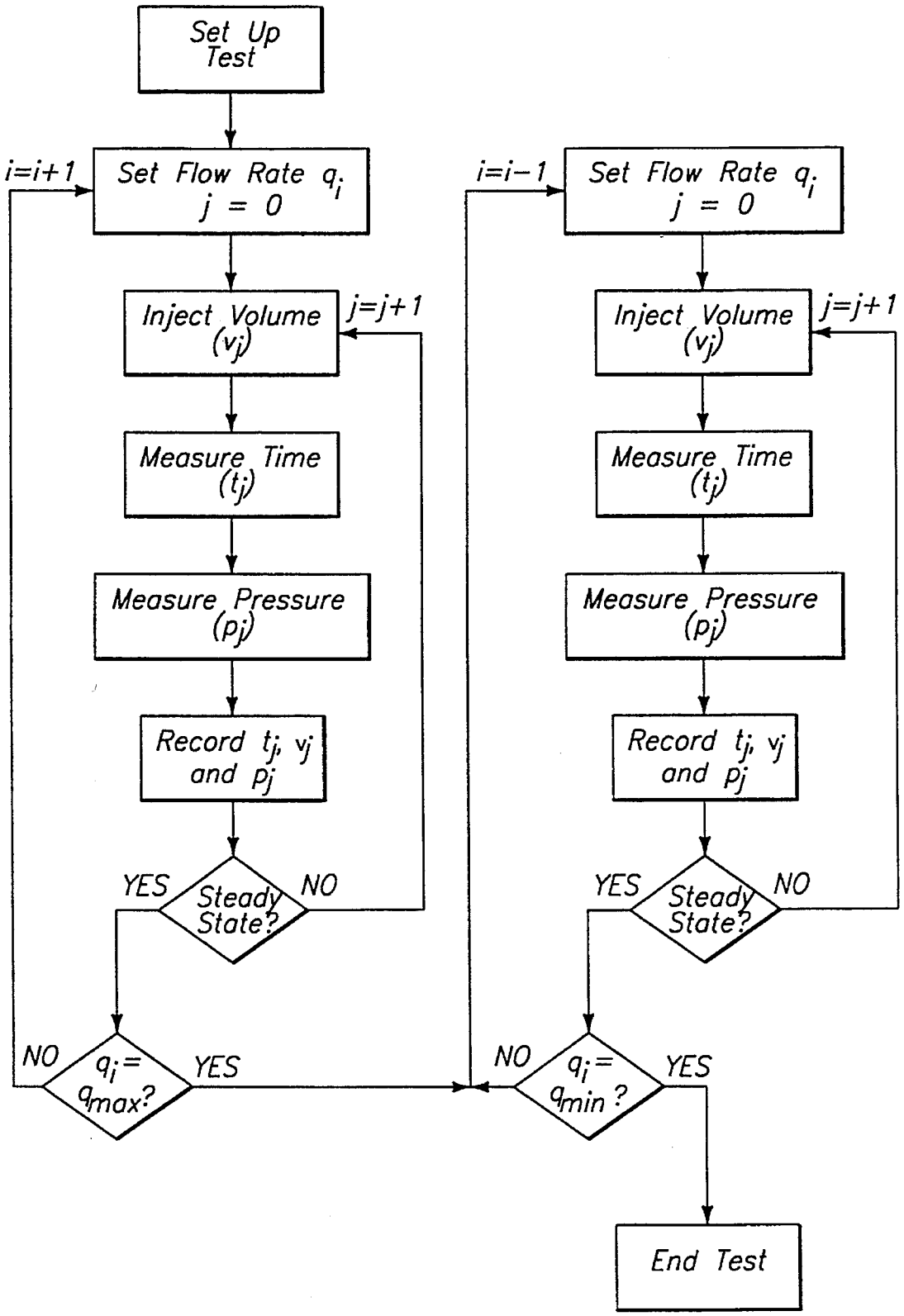

One procedure to perform estimation of in situ unsaturated conductivity using pumping follow-on drying curve data is depicted in FIG. 13. Operation of the inventive permeameter for the drying curve test is accomplished by lowering to depth, inflating the light packer to impress the membrane against the borehole wall, metering water at the desired rate until a steady soil water tension is obtained, ceasing pumping, and then recording the follow-on drying tension values. The process of metering water, obtaining steady state tension, ceasing pumping, and then recording the follow-on drying tension values is repeated at successive rates of pumping until the desired range of flow rates and volumes delivered is spanned.

One procedure for performing forward step hysteresis determination is depicted in FIG. 14. Again, operation of the inventive permeameter for the forward step hysteresis test is accomplished by lowering to depth, inflating the light packer to impress the membrane against the borehole wall, and metering water at the desired rate until a steady soil water tension is obtained. Once a steady soil water tension is obtained, the flow rate is stepped up by a predetermined increment to the next flow rate. After the maximum rate steady state has been observed the system is stepped back down through the same successive lower flow rate values and steady state tension is again obtained at the respective flow values.

Figure 15:
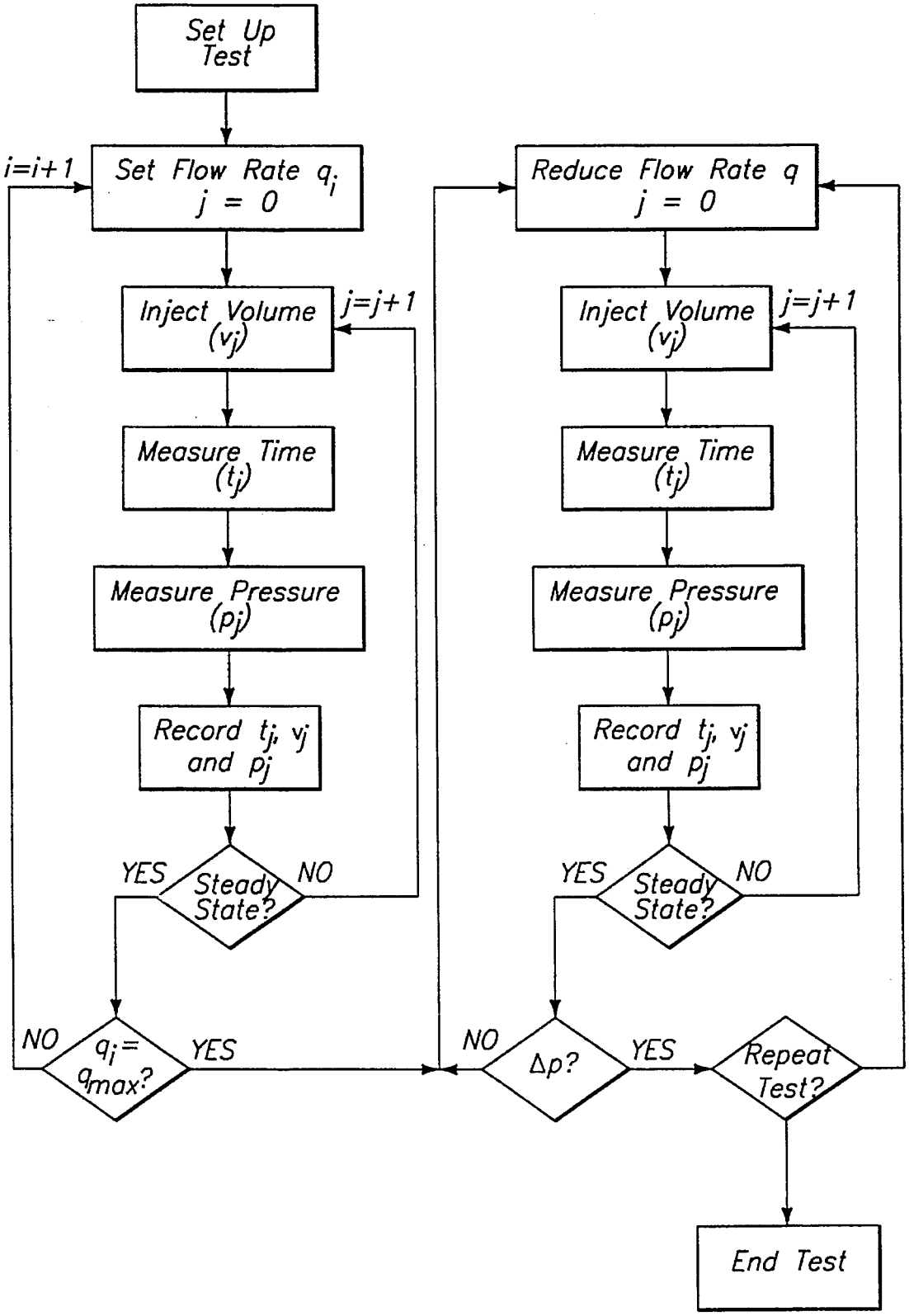
FIG. 15 is a block diagram of a general procedure for performing reverse step hysteresis determination.

One procedure for performing reverse step hysteresis determination is depicted in FIG. 15. Operation of the inventive permeameter for the reverse step hysteresis test is accomplished by lowering to depth, inflating the light packer to impress the membrane against the borehole wall, and metering water at the desired rate until a steady soil water tension is obtained, and metering water at the desired rate until a steady soil water tension is obtained. The process of metering water and obtaining steady state tension is repeated at successive rates of pumping until the desired range of tensions and flow rates is spanned. When the maximum rate steady state has been observed, the system is stepped back down until a change in tension value is observed. The process is repeated until the desired range of "reverse" tensions is acquired.

Data analysis will include determination of unsaturated hydraulic conductivity (K) as a function of tension by using both steady state and drying curve data. Use of steady state data allows graphical and numerical (regression) solution for K. Drying curve data will require numerical analysis by finite difference and finite element method for the determination of the function of K.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A hydraulic conductivity determining apparatus for determining hydraulic conductivity of earthen material comprising:

a semipermeable membrane having a fore earthen material bearing surface and an opposing rear liquid receiving surface;

a pump in fluid communication with the semipermeable membrane rear surface, the pump being capable of delivering liquid to the membrane rear surface at a plurality of selected variable flow rates or at a plurality of selected variable pressures;

an inflatable bladder in communication with the membrane rear surface, the inflatable bladder being positioned to force the fore membrane surface against earthen material;

a liquid reservoir in fluid communication with the pump, the liquid reservoir retaining a liquid for pumping to the membrane rear surface; and a pressure sensor in fluid communication with the membrane rear surface to measure pressure of liquid delivered to the membrane by the pump.

2. The hydraulic conductivity determining apparatus of claim 1 further comprising a microprocessor controlled pump controller.

3. The hydraulic conductivity determining apparatus of claim 1 further comprising a rear membrane surface backing screen.

4. The hydraulic conductivity determining apparatus of claim 1 wherein the reservoir comprises an air-sealable collapsible flexible bladder.

5. The hydraulic conductivity determining apparatus of claim 1 further comprising:

a rear membrane surface backing screen; and an inflatable bladder in communication with the membrane rear surface, the inflatable bladder being positioned to force the fore membrane surface against earthen material.

6. The hydraulic conductivity determining apparatus of claim 1 wherein the pump comprises a syringe.

7. The hydraulic conductivity determining apparatus of claim 1 wherein the pump comprises pair of syringes, each syringe having a respective piston, each syringe having a respective syringe inlet/outlet port;

a valve in fluid communication with each inlet/outlet port, the valves being operable to place the respective inlet/outlet ports in fluid communication with either of the liquid reservoir or the membrane rear surface; and the apparatus further comprising a pump controller, the pump controller being operable to fill one syringe of the pair with liquid from the reservoir while ejecting fluid from the other syringe of the pair to the membrane rear surface.

8. The hydraulic conductivity determining apparatus of claim 7 wherein the pair of syringes are longitudinally opposed, with their respective inlet/outlet ports facing away from one another.

9. The hydraulic conductivity determining apparatus of claim 7 wherein the pair of syringes are longitudinally opposed, with their respective inlet/outlet ports facing away from one another, the piston of each syringe being connected to the other by a common driver, the driver being movable between opposing longitudinal limits, the pump controller being operable to reverse movement of the driver upon driver movement to either of the opposing longitudinal limits.

10. The hydraulic conductivity determining apparatus of claim 7 wherein the pair of syringes are longitudinally opposed and in longitudinal alignment with one another, with their respective inlet/outlet ports facing away from one another, the piston of each syringe being connected to the other by a common drive shaft, the drive shaft being movable between opposing longitudinal limits, the pump controller being operable to reverse movement of the drive shaft upon drive shaft movement to either of the opposing longitudinal limits.

11. An earthen material hydraulic conductivity determining apparatus for determining hydraulic conductivity of in a bore hole of earthen material comprising:

a longitudinally elongated body;

a pair of syringes received within the elongated body, each syringe having a respective piston, each syringe having a respective syringe inlet/outlet port, the syringes being longitudinally opposed within the body with their respective inlet/outlet ports facing away from one another, the piston of each syringe being connected to the other by a common driver, the driver being movable between opposing longitudinal limits;

a liquid reservoir in fluid communication with the inlet/outlet port of each syringe;

a liquid delivery conduit in fluid communication with the inlet/outlet port of each syringe, the liquid delivery conduit having a liquid emitting terminus positionable to emit liquid onto earthen material within the bore;

a valve in fluid communication with each syringe inlet/outlet port, the valves being operable to place the respective inlet/outlet ports in fluid communication with either of the liquid reservoir or the liquid delivery conduit;

a syringe controller, the syringe controller being operable to fill one syringe of the pair with liquid from the reservoir while ejecting fluid from the other syringe of the pair to the liquid delivery conduit, the syringe controller being operable to reverse movement of the driver upon driver movement to either of the opposing longitudinal limits; and a pressure sensor in fluid communication with the liquid delivery conduit to measure pressure of liquid within the delivery conduit.

12. The hydraulic conductivity determining apparatus of claim 11 wherein the pair of syringes are in longitudinal alignment with one another within the elongated body.

13. The hydraulic conductivity determining apparatus of claim 11 wherein the liquid emitting terminus comprises a semipermeable membrane.

14. The hydraulic conductivity determining apparatus of claim 11 wherein the pair of syringes are in longitudinal alignment with one another within the elongated body, and the liquid emitting terminus comprises a semipermeable membrane.

15. The hydraulic conductivity determining apparatus of claim 11 wherein the liquid emitting terminus comprises a semipermeable membrane, the semipermeable membrane having a fore earthen material bearing surface and an opposing rear liquid receiving surface, a rear membrane surface backing screen being received against the rear liquid receiving surface, the liquid delivery conduits being in fluid communication with the screen.

16. The hydraulic conductivity determining apparatus of claim 11 wherein the liquid emitting terminus comprises a semipermeable membrane, the semipermeable membrane being received about an inflatable bladder, the inflatable bladder being operable to radially outward expand the semipermeable membrane to bear against sidewalls of the earthen bore.

17. The hydraulic conductivity determining apparatus of claim 11 wherein the liquid emitting terminus comprises:

a semipermeable membrane, the semipermeable membrane having a fore earthen material bearing surface and an opposing rear liquid receiving surface, a rear membrane surface backing screen being received against the rear liquid receiving surface, the liquid delivery conduits being in fluid communication with the screen; and the semipermeable membrane being received about an inflatable bladder, the inflatable bladder being operable to radially outward expand the semipermeable membrane to bear against sidewalls of the earthen bore.

18. The hydraulic conductivity determining apparatus of claim 11 wherein, the liquid emitting terminus comprises a semipermeable membrane, the semipermeable membrane having a fore earthen material bearing surface and an opposing rear liquid receiving surface, a rear membrane surface backing screen being received against the rear liquid receiving surface, the liquid delivery conduits being in fluid communication with the screen;

the semipermeable membrane is received about an inflatable bladder, the inflatable bladder being operable to radially outward expand the semipermeable membrane to bear against sidewalls of the earthen bore; and the pair of syringes are in longitudinal alignment with one another within the elongated body.

19. The hydraulic conductivity determining apparatus of claim 11 wherein the reservoir comprises an air-sealable collapsible flexible bladder.

20. A method of determining the hydraulic conductivity of earthen material comprising the following steps:

applying a flexible semipermeable membrane against a non-flat earthen material surface, the flexible semipermeable membrane having a fore a non-flat earthen material surface bearing surface and an opposing rear liquid receiving surface;

providing a flow of liquid to the rear semipermeable membrane surface at a first flow rate;

determining pressure of the liquid delivered to the rear surface at the first flow rate;

continuing liquid flow at the first rate until an equilibrium first liquid pressure is determined;

providing a flow of liquid to the rear semipermeable membrane surface at a second flow rate, the second flow rate being different from the first flow rate;

determining pressure of the liquid delivered to the rear surface at the second flow rate;

continuing liquid flow at the second rate until an equilibrium second liquid pressure is determined; and using the determined first and second equilibrium pressures to determine the hydraulic conductivity of the earthen material.

21. The method of determining the hydraulic conductivity of earthen material of claim 20 wherein the semipermeable membrane is flexible, and the applying step comprises applying the semipermeable membrane against an arcuate earthen material surface.

22. A method of determining the hydraulic conductivity of earthen material comprising the following steps:

applying a flexible semipermeable membrane against non-flat earthen material surface, the semipermeable membrane having a fore earthen material bearing surface and an opposing rear liquid receiving surface;

providing a flow of liquid to the rear semipermeable membrane surface at a first constant pressure;

varying the flow of liquid to the rear membrane surface to maintain the first constant pressure;

continuing to vary the flow of liquid to maintain the first constant pressure until an equilibrium first flow rate is achieved;

providing a flow of liquid to the rear semipermeable membrane surface at a second constant pressure, the second constant pressure being different from the first constant pressure;

varying the flow of liquid to the rear membrane surface to maintain the second constant pressure;

continuing to vary the flow of liquid to maintain the second constant pressure until an equilibrium second flow rate is achieved; and using the first and second equilibrium flow rates to determine the hydraulic conductivity of the earthen material.

23. The method of determining the hydraulic conductivity of earthen material of claim 22 wherein the semipermeable membrane is flexible, and the applying step comprises applying the semipermeable membrane against an arcuate earthen material surface.

24. A method of determining the hydraulic conductivity of earthen material comprising the following steps:

applying a semipermeable membrane against earthen material, the semipermeable membrane having a fore earthen material bearing surface and an opposing rear liquid receiving surface;

providing a flow of liquid to the rear semipermeable membrane surface at a first constant flow rate for a period of time;

monitoring variations in pressure of the liquid delivered to the rear surface at the first constant flow rate over the period of time; and using the monitored variations to determine the hydraulic conductivity of the earthen material.

25. The method of determining the hydraulic conductivity of earthen material of claim 24 wherein the semipermeable membrane is flexible, and the applying step comprises applying the semipermeable membrane against a non-flat earthen material surface.

26. The method of determining the hydraulic conductivity of earthen material of claim 24 wherein the semipermeable membrane is flexible, and the applying step comprises applying the semipermeable membrane against an arcuate earthen material surface.

27. A method of determining the hydraulic conductivity of earthen material comprising the following steps:

applying a semipermeable membrane against earthen material, the semipermeable membrane having a fore earthen material bearing surface and an opposing rear liquid receiving surface;

providing a flow of liquid to the rear semipermeable membrane surface for a period of time;

monitoring pressure of the liquid flowing to the rear semipermeable membrane surface over the period of time;

varying the rate of liquid flow over the period of time to maintain a constant liquid pressure over the period of time;

monitoring the variations in the rate of liquid flow over the period of time; and using the monitored variations to determine the hydraulic conductivity of the earthen material.

28. The method of determining the hydraulic conductivity of earthen material of claim 27 wherein the semipermeable membrane is flexible, and the applying step comprises applying the semipermeable membrane against a non-flat earthen material surface.

29. The method of determining the hydraulic conductivity of earthen material of claim 27 wherein the semipermeable membrane is flexible, and the applying step comprises applying the semipermeable membrane against an arcuate earthen material surface.

* * * * *